US007607315B2

(12) United States Patent
Ohta

(10) Patent No.: US 7,607,315 B2
(45) Date of Patent: Oct. 27, 2009

(54) PRESSURE CONTROL VALVE AND VAPOR-COMPRESSION REFRIGERANT CYCLE SYSTEM USING THE SAME

(75) Inventor: Hiromi Ohta, Okazaki (JP)

(73) Assignee: Denso Corporation, Kariya (JP)

( * ) Notice: Subject to any disclaimer, the term of this patent is extended or adjusted under 35 U.S.C. 154(b) by 775 days.

(21) Appl. No.: 11/147,029

(22) Filed: Jun. 7, 2005

(65) Prior Publication Data

US 2005/0274132 A1 Dec. 15, 2005

(30) Foreign Application Priority Data

Jun. 9, 2004 (JP) ..... 2004-171746

(51) Int. Cl.
*F25B 41/04* (2006.01)

(52) U.S. Cl. ..... 62/217; 62/222

(58) Field of Classification Search ..... 62/140, 62/148, 151, 156, 157, 217, 222, 225, 228.1, 62/299; 137/205, 468, 503, 508, 513.5, 614, 137/854, 856; 236/92 B See application file for complete search history.

(56) References Cited

U.S. PATENT DOCUMENTS

| | | | | |
|---|---|---|---|---|
| 5,890,370 | A * | 4/1999 | Sakakibara et al. | 62/222 |
| 6,012,300 | A | 1/2000 | Tomatsu et al. | |
| 6,230,506 | B1 | 5/2001 | Nishida et al. | |
| 6,505,476 | B1 | 1/2003 | Nishida et al. | |
| 2003/0168108 | A1 | 9/2003 | Ise et al. | |

FOREIGN PATENT DOCUMENTS

| | | |
|---|---|---|
| JP | 10-325480 | 12/1998 |
| JP | 2002-162133 | 6/2002 |
| JP | 2002-174471 | 6/2002 |
| JP | 2003-279177 | 10/2003 |
| JP | 2004-218858 | 8/2004 |
| WO | WO 93/06423 | 4/1993 |

OTHER PUBLICATIONS

Office Action dated Oct. 23, 2007 in Japanese Application No. 2004-171746 with English translation.

* cited by examiner

*Primary Examiner*—Chen-Wen Jiang
(74) *Attorney, Agent, or Firm*—Harness, Dickey & Pierce, PLC

(57) ABSTRACT

A pressure control valve includes a valve portion disposed in a passage from a refrigerant radiator to a suction port of a refrigerant compressor in a vapor-compression refrigerant cycle system. The valve portion controls a refrigerant pressure at an outlet of the refrigerant radiator in accordance with a refrigerant temperature at the outlet of the refrigerant radiator, and the valve portion has a control pressure characteristic in which a pressure change relative to a temperature is smaller than that of the refrigerant. Furthermore, the valve portion may have a fluid passage through which refrigerant flows even when a valve port of the valve portion is closed by a valve body. Accordingly, when the refrigerant radiator is used for heating a fluid, heating capacity for heating the fluid can be rapidly increased at a heating start time.

19 Claims, 5 Drawing Sheets

FIG. 1A
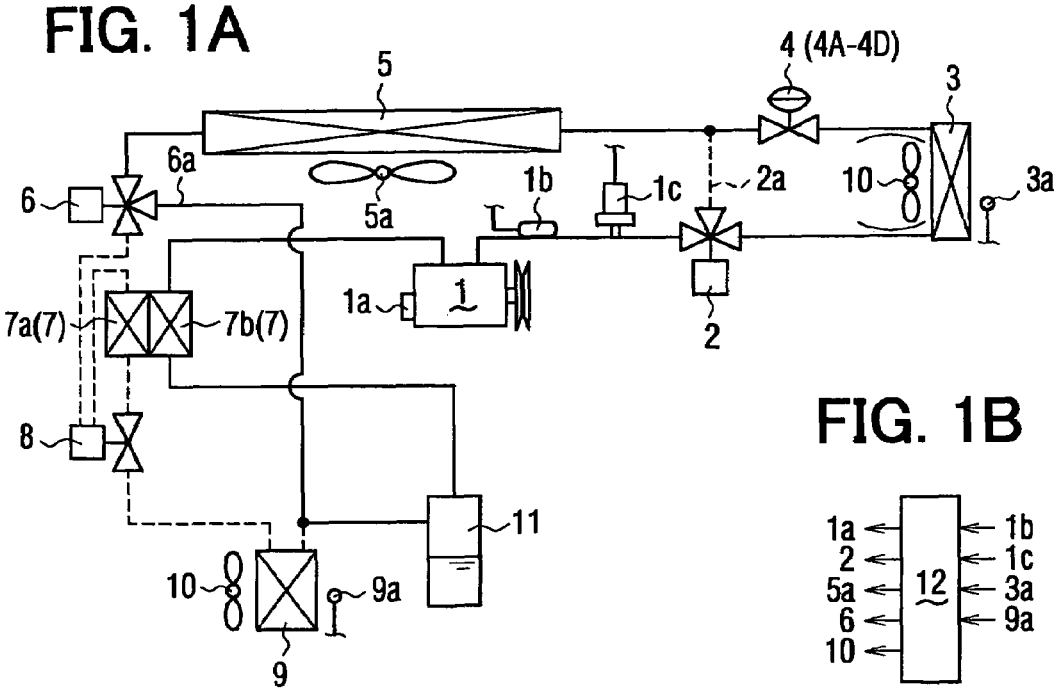
FIG. 1B
FIG. 2
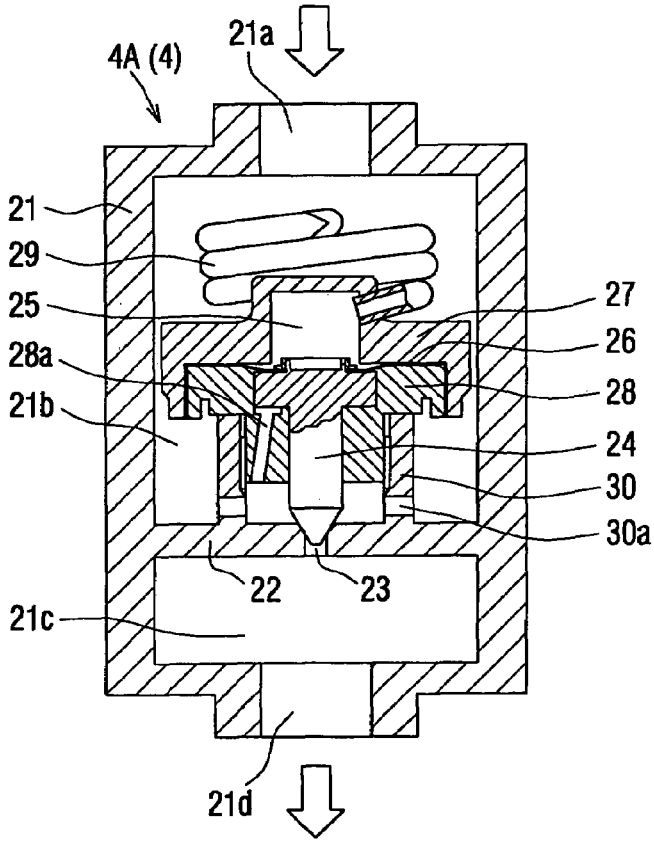

PRESSURE CONTROL VALVE AND VAPOR-COMPRESSION REFRIGERANT CYCLE SYSTEM USING THE SAME

CROSS REFERENCE TO RELATED APPLICATION

This application is based on Japanese Patent Application No. 2004-171746 filed on Jun. 9, 2004, the contents of which are incorporated herein by reference in its entirety.

FIELD OF THE INVENTION

The present invention relates to a pressure control valve for controlling an outlet pressure of a refrigerant radiator (e.g., gas cooler) in a vapor-compression refrigerant cycle system (e.g., supercritical heat pump cycle system). The vapor-compression refrigerant cycle system may be suitably used for a vehicle air conditioner having a heating function for heating a passenger compartment.

BACKGROUND OF THE INVENTION

In a supercritical heat pump cycle system using CO2 as refrigerant, for example, a gas cooler is used for heating a fluid, and an externally driven decompression device such as an electrical expansion valve is provided for controlling the operation state of the cycle system. However, in this case, a pressure sensor for detecting a refrigerant pressure and a control circuit for driving the electrical expansion valve are required, thereby increasing the cost.

When a mechanical expansion valve is used, a heat radiating amount of the gas cooler becomes larger when the outside air temperature is low. In this case, a refrigerant temperature at an outlet of the gas cooler decreases and a control pressure of the expansion valve decreases. Therefore, temperature of air to be blown from the gas cooler is greatly decreased.

Further, when a heating operation is performed in a supercritical heat pump cycle system using CO2 as refrigerant, even when a low-pressure refrigerant pressure decreases, the mechanical expansion valve is not opened until a high-pressure refrigerant pressure reaches a valve-open pressure, in order to control the high-press refrigerant pressure. Therefore, if the mechanical expansion valve is used as the decompression device of the supercritical heat pump cycle system, the low-pressure refrigerant pressure decreases at a time immediately after a refrigerant cycle start because the mechanical expansion valve is closed at the refrigerant cycle start.

FIG. 8A shows an example with a bad start condition and FIG. 8B shows an example with a good start condition, when a mechanical expansion valve of a comparison example is used in a super-critical heat pump cycle system. In this case of FIG. 8A, when the outside air temperature Tam becomes equal to or lower than −10° C. (e.g., −20° C. in FIG. 8A), the saturated refrigerant pressure becomes lower, and the pressure (i.e., the suction pressure of the compressor) of the low-pressure refrigerant at a refrigerant-cycle start time becomes lower. In this case, the high-pressure refrigerant pressure discharged from the compressor does not reach a valve-open pressure of the mechanical expansion valve. Accordingly, the flow amount of refrigerant flowing through the heat pump cycle system becomes almost zero, and heating capacity with the heat pump cycle system may be not obtained.

SUMMARY OF THE INVENTION

In view of the above-described problems, it is an object of the present invention to provide a pressure control valve which has a control pressure characteristic in which a pressure change relative to a temperature is smaller than that of the refrigerant.

It is another object of the present invention to provide a pressure control valve, which controls a refrigerant pressure at an outlet of a refrigerant radiator in accordance with a refrigerant temperature at the outlet of the refrigerant radiator with a simple structure.

It is further another object of the present invention to provide a vapor-compression refrigerant cycle system using the pressure control valve, which prevents the pressure of a low-pressure refrigerant from being excessively lowered at a low outside air temperature.

According to an aspect of the present invention, a pressure control valve for a vapor-compression refrigerant cycle system includes a valve portion disposed in a refrigerant passage from a refrigerant radiator to a suction port of a refrigerant compressor. In the pressure control valve, the valve portion controls a refrigerant pressure at an outlet of the refrigerant radiator in accordance with a refrigerant temperature at the outlet of the refrigerant radiator. Furthermore, the valve portion has a control pressure characteristic in which a pressure change relative to a temperature is smaller than that of the refrigerant. In this case, it is possible to set a control pressure of a high-pressure refrigerant to a high value even at a low outside air temperature, regardless of the coefficient of performance (COP) in the cycle system. Therefore, when the refrigerant radiator is used for heating a fluid, e.g., air to be blown to a vehicle compartment, the heating temperature due to the refrigerant radiator can be prevented from decreasing when the outside air temperature is low.

For example, the valve portion includes a casing for defining a refrigerant passage, a partition portion arranged in the refrigerant passage to partition an inner space of the casing into an upstream space and a downstream space, a valve port provided in the partition portion, through which the upstream space communicates with the downstream space, a sealed space provided inside the upstream space, a film-shaped displacement member provided in the upstream space, and a valve body which is connected to the displacement member and is moved in accordance with a movement of the displacement member to open and close the valve port. Here, the displacement member moves in accordance with a pressure difference between an inside and an outside of the sealed space within the upstream space, and the sealed space is filled with a gas that has a pressure change with respect to temperature, smaller than that of the refrigerant.

Accordingly, a control pressure at the outlet of the refrigerant radiator due to the pressure control valve is changed in accordance with the refrigerant temperature at the outlet of the refrigerant radiator. For example, when the high-pressure refrigerant pressure increases higher than the control pressure, the displacement member is moved so that the valve body opens the valve port. Therefore, the high-pressure refrigerant pressure can be set in a set range.

Alternatively, in a pressure control valve, a transmission rod is connected to the displacement member and is moved in accordance with a movement of the displacement member, and an elastic member is disposed in the downstream space.

Furthermore, a valve body is disposed to open and close the valve port from the downstream space by a biasing force of the elastic member, and a sealed space provided inside the upstream space is filled with a gas that has a pressure change with respect to temperature, smaller than that of the refrigerant. Even in this case, the refrigerant pressure at the high-pressure side of the cycle system can be controlled using the pressure control valve with a simple structure.

Furthermore, the transmission rod has a tip end that is arranged to contact a tip end of the valve body. In this case, when a temperature outside the sealed space within the upstream space is lower than a first value, the displacement member pushes the valve body through the transmission rod so that the valve port is opened by an opening degree. Therefore, it is possible to flow the refrigerant in the cycle system.

Further, the transmission rod may include a tip rod portion having the tip end, and the tip rod portion may be movable in the valve port. The tip end of the transmission rod is separated from the tip end of the valve body when the temperature outside the sealed space within the upstream space is higher than a second value that is higher than the first value. Therefore, the high-pressure refrigerant pressure can be suitably controlled.

The partition wall may have a bypass hole through which the upstream space communicates with the downstream space and the refrigerant flows while bypassing the valve port. Alternatively, the valve port has a seat portion which is arranged to contact the valve body, and the seat portion has a groove portion through which the upstream space communicates with the downstream space even when the valve body contacts the seat portion. Accordingly, even at a start time of the vapor-compression refrigerant cycle system, refrigerant flows in the cycle system, and the heating temperature due to the refrigerant radiator can be increased for a short time.

For example, the valve portion has a valve-open pressure that is 10±1.5 MPa at 40° C., and is 8±1.5 MPa at 0° C. In this case, the actual cycle system is controlled with a pressure that is higher than the valve-open pressure by a pressure due to a valve lift amount.

The vapor-compression refrigerant cycle system using the pressure control valve can be suitably used for heating a fluid, for example, air. In this case, the pressure control valve prevents the pressure of a low-pressure refrigerant from being excessively lowered at a heating start time, and heating capacity due to the refrigerant radiator can be improved.

BRIEF DESCRIPTION OF THE DRAWINGS

The above and other objects, features and advantages of the present invention will become more apparent from the following detailed description of exemplary embodiments made with reference to the accompanying drawings, in which:

FIG. 1A is a schematic diagram showing a vapor-compression refrigerant cycle system according to exemplary embodiments of the present invention, and FIG. 1B is a block diagram showing a control portion of the vapor-compression refrigerant cycle system;

FIG. 2 is a sectional view showing a mechanical expansion valve (pressure control valve) used for a vapor-compression refrigerant cycle system, according to a first exemplary embodiment of the present invention;

FIGS. 8A and 8B are graphs showing relationships between a refrigerant discharge pressure, a refrigerant suction pressure and a refrigerant flow amount when an outside air temperature Tam is −20° C. and a compressor rotation speed Rcom is 1500 rpm in a supercritical heat pump cycle system using a mechanical expansion valve of a comparison example, in which FIG. 8A is an example with a bad start condition and FIG. 8B is an example with a good start condition.

DETAILED DESCRIPTION OF EXEMPLARY EMBODIMENTS

First Exemplary Embodiment

Figure 3:
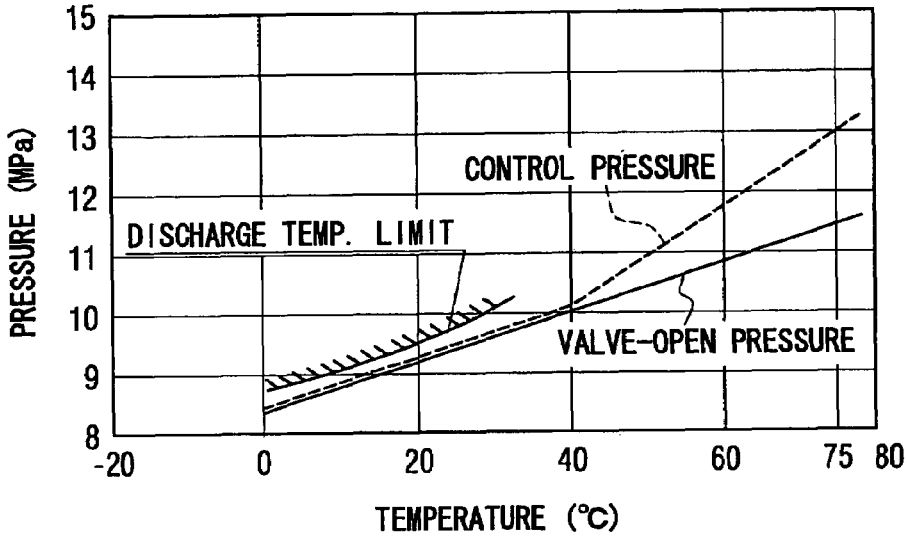
FIG. 3 is a graph showing a relationship between a temperature and a pressure of the mechanical expansion valve.

In the first exemplary embodiment, a mechanical expansion valve 4A is typically used as a pressure control valve 4 for a vapor-compression refrigerant cycle system, for example, a supercritical heat pump cycle system. In a heating operation, refrigerant flows along the solid line shown in FIG. 1A in the vapor-compression refrigerant cycle system when the vapor-compression refrigerant cycle system is used for a vehicle air conditioner. As an example, a supercritical heat pump cycle system is used as the vapor-compression refrigerant cycle system, and CO2 is used as the refrigerant in the supercritical heat pump cycle system.

A compressor 1 for compressing gas refrigerant is driven by a driving force from a vehicle engine. High-temperature and high-pressure refrigerant discharged from the compressor 1 flows to an interior heat exchanger 3 (i.e., gas cooler, refrigerant radiator) through a first electrical three-way valve 2 in the heating operation. The interior heat exchanger 3 is located in a passenger compartment to heat air to be blown into the passenger compartment, for example. The compressor 1 is a variable displacement compressor having a variable displacement mechanism 1*a*.

A temperature sensor 1*b* such as a thermistor is disposed at a refrigerant discharge side of the compressor 1 and detects a temperature of high-pressure refrigerant discharged from the compressor 1. A pressure sensor 1*c* is located at a refrigerant discharge side of the compressor 1 and detects a pressure of the high-pressure refrigerant discharged from the compressor 1.

A first bypass passage 2*a* is provided so that refrigerant discharged from the compressor 1 bypasses the interior heat exchanger 3 and the mechanical expansion valve 4 through the first bypass passage 2*a* in a cooling operation for cooling air.

The interior heat exchanger 3 is a refrigerant radiator, in which refrigerant is heat-exchanged with air to be blown by a blower 10 into a passenger compartment so that air is heated and the refrigerant is cooled in the interior heat exchanger 3. An evaporator 9 is disposed in the passenger compartment downstream of the blower 10, in the vehicle air conditioner. Furthermore, the interior heat exchanger 3 is disposed downstream of the evaporator 9 so that air having passed through the evaporator 9 flows to the interior heat exchanger 3. An air temperature sensor 3*a* is disposed to detect temperature of air after passing through the interior heat exchanger 3.

The refrigerant flowing out of the interior heat exchanger 3 flows into a first mechanical expansion valve 4 (4A) for heating. The first mechanical expansion valve 4 is a pressure control valve which controls a refrigerant pressure at an outlet portion of the interior heat exchanger 3 in accordance with a refrigerant temperature at the outlet portion of the interior heat exchanger 3. The first mechanical expansion valve 4 is also used as a decompression device which decompresses refrigerant so as to control the refrigerant pressure at the outlet portion of the interior heat exchanger 3. Refrigerant is decompressed in the first mechanical expansion valve 4 to have a low temperature and a low pressure. The low-temperature and low-pressure gas-liquid refrigerant discharged from the first mechanical expansion valve 4 flows to an exterior heat exchanger 5.

The exterior heat exchanger 5 is used as a refrigerant radiator in the cooling operation. That is, in the cooling operation, high-temperature and high-pressure refrigerant discharged from the compressor 1 is heat-exchanged with outside air blown by an exterior blower 5*a* and is cooled by outside air. In contrast, in the heating operation, the exterior heat exchanger 5 is used as a refrigerant evaporator in which gas-liquid two-phase refrigerant supplied from the first mechanical expansion valve 4 is heat-exchanged with outside air and evaporated by absorbing evaporation latent heat from outside air. The exterior heat exchanger 5 is generally arranged at a vehicle front side so that a temperature difference between refrigerant in the exterior heat exchanger 5 and outside air can be made larger.

In the heating operation, a second electrical three-way valve 6 is switched so that the refrigerant flowing out of the exterior heat exchanger 5 flows into an accumulator 11 through a second bypass passage 6*a*. In the heating operation, refrigerant bypasses a high-pressure refrigerant passage 7*a* of an inner heat exchanger 7, a second mechanical expansion valve 8 (cooling mechanical expansion valve 8) and the evaporator 9. The inner heat exchanger 7 is a heat exchanger in which high-pressure refrigerant before being decompressed in the second mechanical expansion valve 8 is heat-exchanged with low-pressure refrigerant to be drawn to the compressor 1, during the cooling operation.

In the cooling operation, the second electrical three-way valve 6 is switched such that the refrigerant flowing out of the exterior heat exchanger 5 flows into the accumulator 11 through the high-pressure refrigerant passage 7*a* of the inner heat exchanger 7, the second mechanical expansion valve 8 and the evaporator 9. Through heat exchange between high-pressure refrigerant flowing in the high-pressure refrigerant passage 7*a* and low pressure flowing in a low-pressure refrigerant passage 7*b* in the inner heat exchanger 7, the refrigerant flowing to the second mechanical expansion valve 8 is cooled, an enthalpy of the refrigerant flowing to the evaporator 9 becomes smaller, and a super-heating degree of the refrigerant to be drawn to the compressor 1 becomes larger.

The second mechanical expansion valve 8 has a structure similar to that of JP-A-2000-81157, and the contents of which are incorporated herein by reference. The second mechanical expansion valve 8 has a temperature sensing portion for detecting a refrigerant temperature at an outlet portion of the exterior heat exchanger 5, and controls a valve portion for decompressing refrigerant flowing from the high-pressure refrigerant passage 7*a* of the inner heat exchanger 7 in the cooling operation. That is, the second mechanical expansion valve 8 decompresses refrigerant in the cooling operation so that COP of the refrigerant cycle system is increased in maximum in the cooling operation.

The evaporator 9 is a cooling heat exchanger in the cooling operation. In the cooling operation, gas-liquid two-phase refrigerant supplied from the second mechanical expansion valve 8 is heat-exchanged with air blown by the interior blower 10 and is evaporated by absorbing evaporation latent heat from air. Therefore, air passing through the evaporator 9 is cooled. A cool air temperature sensor 9*a* is disposed to detect the temperature of air after passing through the evaporator 9.

The accumulator (gas-liquid separator) 11 has a tank in which gas refrigerant is separated from liquid refrigerant and the separated liquid refrigerant is temporarily stored therein. The gas refrigerant separated in the tank of the accumulator 11 is drawn to the compressor 1 through the low-pressure refrigerant passage 7*b* of the inner heat exchanger 7.

FIG. 1B shows a control device 12 of the refrigerant cycle system. Signals from the refrigerant temperature sensor 1*b*, the refrigerant pressure sensor 1*c*, the air temperature sensor 3*a* and the air temperature sensor 9*a* are input to the control device 12. Then, the control device 12 outputs control signals to the variable displacement mechanism 1*a*, the first electrical three-way valve 2, the exterior blower 5*a*, the second electrical three-way valve 6 and the interior blower 10, in accordance with a control program.

Next, the structure of the first mechanical expansion valve 4A (4) will be described. FIG. 2 shows a valve closing state of the first mechanical expansion valve 4A. The first mechanical expansion valve 4A is arranged between the interior heat exchanger 3 and a suction side of the compressor 1, and is used for controlling the refrigerant pressure during the heating operation. The first mechanical expansion valve 4A is a pressure control valve 4 that controls the refrigerant pressure at the outlet portion of the interior heat exchanger 3 in accordance with the refrigerant temperature at the outlet portion of the interior heat exchanger 3.

The mechanical expansion valve 4A has a casing 21 for defining a refrigerant passage. The casing 21 has an inlet port 21*a* at one end, and an outlet port 21*d* at the other end. A partition wall 22 is provided inside of the casing 21 and partitions an inner space of the casing 21 into an upstream space 21*b* and a downstream space 21*c*. A valve port 23 is provided in the partition wall 22 so that the upstream space 21*b* and the downstream space 21*c* communicate with each other through the valve port 23. A pressure control portion of the pressure control valve 4A is accommodated in the upstream space 21*b* which communicates with the outlet portion of the interior heat exchanger 3 through the inlet port 21*a*.

The valve port 23 is opened and closed by a needle valve body 24. The needle valve 24 is connected to a film-shaped diaphragm 26 made of a stainless material. Therefore, the needle valve 24 is moved in accordance with a movement of the diaphragm 26. When the diaphragm 26 moves toward the valve body 24, the needle valve 24 is moved in a direction for closing the valve port 23. In contrast, when the diaphragm 26 moves to a direction opposite to the valve body 24, the needle valve 24 is moved to fully open the valve port 23.

The diaphragm 26 is inserted between a first support member 27 and a second support member 28 within the upstream space 21*b*. A sealed space (gas sealing chamber) 25 is formed by the first support member 27 at one side of the diaphragm 26, opposite to the valve body 24. The seal space 25 is provided so that the diaphragm 26 is displaced in accordance with a pressure difference between an inside and an outside of the sealed space 25 within the upstream space 21*b*. A capillary tube 29 is connected to the first support member 27 and communicates with the sealed space 25. A pressure introduction hole 28*a* is provided in the second support member 28 so that the refrigerant pressure at the outlet portion of the interior heat exchanger 3 is introduced to a space and is applied to the diaphragm 26 at a side opposite to the sealed space 25.

An element support portion 30 is formed in a cylinder shape around the valve port 23 within the upstream space 21. The second support member 28 is fixed to the element support portion 30 through a screw connection. Plural refrigerant flow holes 30*a* are provided in the element support portion 30 to penetrate through a wall portion of the element support portion 30. Gas, for example, nitrogen is filled in the sealed space 25. Generally, the gas filled in the sealed space 25 has a pressure change with respective to temperature around the sealed space 25, which is smaller than that of the refrigerant (e.g., CO2).

Next, operation of the refrigerant cycle system will be described.

Figure 4:
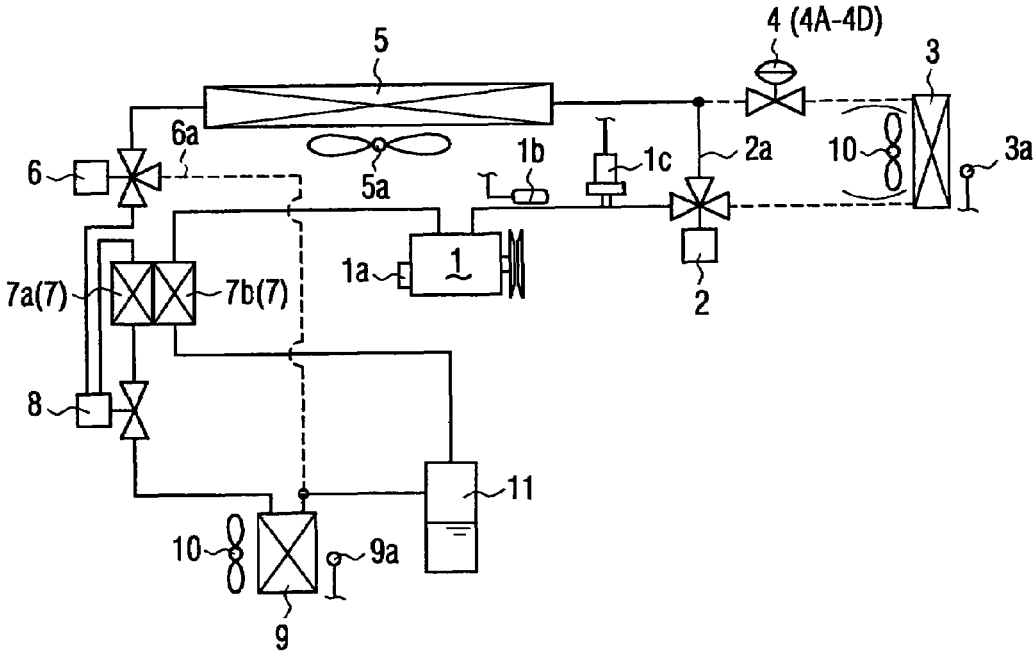
FIG. 4 is a schematic diagram showing a cooling operation state of the vapor-compression refrigerant cycle system in FIG. 1A.

In the cooling operation of the refrigerant cycle system, refrigerant flows along the solid line shown in FIG. 4. In the cooling operation, the first electrical three-way valve 2 is operated so that high-temperature and high-pressure refrigerant discharged from the compressor 1 directly flows to the exterior heat exchanger 5 through the first bypass passage 2*a* while bypassing the interior heat exchanger 3 and the first mechanical expansion valve 4. The high-temperature refrigerant flowing into the exterior heat exchanger 5 is heat-exchanged with outside air blown by the exterior blower 5*a* and is cooled by the outside air.

The refrigerant flowing out of the exterior heat exchanger 5 flows to the high-pressure refrigerant passage 7*a* of the inner heat exchanger 7 through the second electrical three-way valve 6, and is heat-exchanged with low-pressure refrigerant flowing through the low-pressure refrigerant passage 7*b*. The flow direction of refrigerant in the high-pressure refrigerant passage 7*a* may be set opposite to the flow direction of refrigerant in the low-pressure refrigerant passage 7*b*, in the inner heat exchanger 7. The refrigerant flowing out of the high-pressure refrigerant passage 7*a* is decompressed in the second mechanical expansion valve 8, and then flows into the evaporator 9. The refrigerant flowing through the evaporator 9 is heat-exchanged with air blown by the interior blower 10. Therefore, air to be blown to the passenger compartment is cooled in the evaporator 9.

The refrigerant flowing out of the evaporator 9 flows to the accumulator 11, and gas refrigerant separated in the accumulator 11 is drawn to a suction port of the compressor 1 through the low-pressure refrigerant passage 7*b* of the inner heat exchanger 7.

In the heating operation of the refrigerant cycle system, refrigerant flows along the solid line in FIG. 1A. In the heating operation of the refrigerant cycle system, high-temperature and high-pressure refrigerant discharged from the compressor 1 flows into the interior heat exchanger 3 through the first electrical three-way valve 2, and heats air blown by the interior blower 10. The refrigerant flowing out of the interior heat exchanger 3 is decompressed in the first mechanical expansion valve 4, and is evaporated in the exterior heat exchanger 5. Then, the refrigerant flowing out of the exterior heat exchanger 5 flows into the accumulator 11. Gas refrigerant separated in the accumulator 11 is drawn to the suction side of the compressor 1 through the low-pressure refrigerant passage 7*b*. In this case, the low-pressure refrigerant passage 7*b* is used only as a refrigerant passage without a heat exchange.

In the first embodiment, high-pressure side refrigerant pressure is controlled by the first mechanical expansion valve 4 during the heating operation, and is controlled by the second mechanical expansion valve 8 during the cooling operation. During the heating operation, the high-pressure side refrigerant pressure is set based on the valve-open control pressure characteristic of the first mechanical expansion valve 4. Therefore, during the heating operation, the temperature of air to be blown cannot be controlled by the high-pressure side refrigerant pressure due to the first mechanical expansion valve 4. In this embodiment, the temperature of air blown from the interior heat exchanger 3 is controlled by controlling the discharge capacity of the compressor 1.

In this embodiment, the interior heat exchanger 3 is arranged at a discharge side of the compressor 1, and the refrigerant pressure in the interior heat exchanger 3 is set higher than the critical pressure of the refrigerant. Further, the first mechanical expansion valve 4 is a pressure control valve, which controls the refrigerant pressure at the outlet portion of the interior heat exchanger 3 in accordance with a refrigerant temperature at the outlet portion of the interior heat exchanger 3.

The sealed space 25 filled with gas is provided within the upstream space 21*b* in which the refrigerant at the outlet of the exterior heat exchanger 3 is introduced. In addition, the gas sealed in the sealed space 25 of the first mechanical expansion valve 4 has a pressure change relative to the temperature, which is smaller than that of the refrigerant circulating in the refrigerant cycle system. Therefore, it is possible to control the pressure in the refrigerant cycle system so that a maximum heating capacity of the interior heat exchanger 3 can be obtained in the heating operation. Thus, even when the outside air temperature is low, the pressure of the high-pressure refrigerant can be maintained at a high value, and the temperature of air blown from the interior heat exchanger 3 is prevented from being decreased. That is, in this embodiment, during the heating operation, the pressure of the high-pressure side refrigerant can be controlled regardless of the coefficient of performance (COP) of the refrigerant cycle system in the heating operation. As a result, heating capacity of the interior heat exchanger 3 can be maintained, and a time for which the heating temperature can be increased can be made shorter.

In the mechanical expansion valve 4 of this embodiment, the partition wall 22 for partitioning the inner space of the casing 21 into the upstream space 21*b* and the downstream space 21*c* is provided in the casing 21. Further, the valve port 23 through which the upstream space 21*b* and the downstream space 21*c* communicate with each other is formed in the partition wall 22. The sealed space 25 is formed in the upstream space 21*b*, and the diaphragm 26 is displaced in accordance with a pressure difference between the inside of the sealed space 25, and the outside of the sealed space 25 within the upstream space 21*b*. The valve body 24 for opening and closing the valve port 23 is connected to the diaphragm 26 at one side in a moving direction (thickness direction) of the diaphragm 26. Therefore, the valve body 24 is moved together with a movement of the diaphragm 26. The sealed space 25 of the mechanical expansion valve 4 is filled with gas that has a pressure change relative to the temperature, smaller than that of the refrigerant in the refrigerant cycle system.

The refrigerant at the outlet portion of the interior heat exchanger 3 is introduced to the upstream space 21*b* outside the sealed space 25. That is, the sealed space 25 filled with gas having a small pressure change relative to the temperature is arranged in the refrigerant condition at the outlet side of the interior heat exchanger 3. Therefore, a control pressure of the interior heat exchanger 4 changes based on the refrigerant temperature at the outlet portion of the interior heat exchanger 3, and the sealed gas of the mechanical expansion valve 4 has a control pressure characteristic where a pressure change relative to the temperature is smaller than that of the refrigerant. When the pressure of the high-pressure refrigerant increases higher than a control pressure of the mechanical expansion valve 4, the diaphragm 26 is moved up in FIG. 2, and the valve body 24 connected to the diaphragm 26 is also moved to open the valve port 23. Therefore, the pressure of the high-pressure side refrigerant can be maintained at a set pressure.

The mechanical expansion valve (pressure control valve) 4 has a valve-open pressure characteristic in which the valve-open pressure is 10±1.5 MPa at a temperature of 40° C., and the valve-open pressure is 8.3±1.5 MPa at a temperature of 0° C. FIG. 3 is a graph showing the relationship between the temperature and the pressure in the mechanical expansion valve 4. The solid line in FIG. 3 shows the valve-open pressure characteristic, and the chain line in FIG. 3 shows the control pressure of the mechanical expansion valve 4 at the high-pressure side in the refrigerant cycle system. When the temperature around the valve element is higher than 40° C., a valve lift amount is increased, and the actual control pressure is increased by the valve lift in the refrigerant cycle system more than the valve-open pressure.

Furthermore, the valve-open pressure relative to the refrigerant temperature is set in a pressure range so that the discharge refrigerant temperature is within an allowable temperature range, and is set so that a maximum heating capacity can be obtained while a maximum pressure in a using temperature range is made lower than a designed pressure. In this embodiment, the valve-open pressure is set equal to or lower than 13 MPa at temperature 75° C.

When an inner pressure of the refrigerant in the interior heat exchanger 3 is higher than the critical pressure, a fluid (e.g., air) passing the interior heat exchanger 3 is heated by gas refrigerant flowing in the interior heat exchanger 3 without condensation of gas refrigerant. In this embodiment, the first mechanical expansion valve 4 is arranged downstream of the interior heat exchanger 3 in a refrigerant flow direction. Therefore, it is possible to maintain the control pressure of the high-pressure refrigerant at a high value even in a low outside air temperature at a start time of the heating operation. Further, a heating temperature due to the interior heat exchanger 3 can be increased for a short time.

Because the mechanical expansion valves 4, 8 are used, it is unnecessary to provide a refrigerant temperature detecting sensor at a downstream refrigerant side of the interior heat exchanger 3 or the exterior heat exchanger 5. Therefore, the refrigerant cycle system has a simple structure.

Second Exemplary Embodiment

Figure 5A:
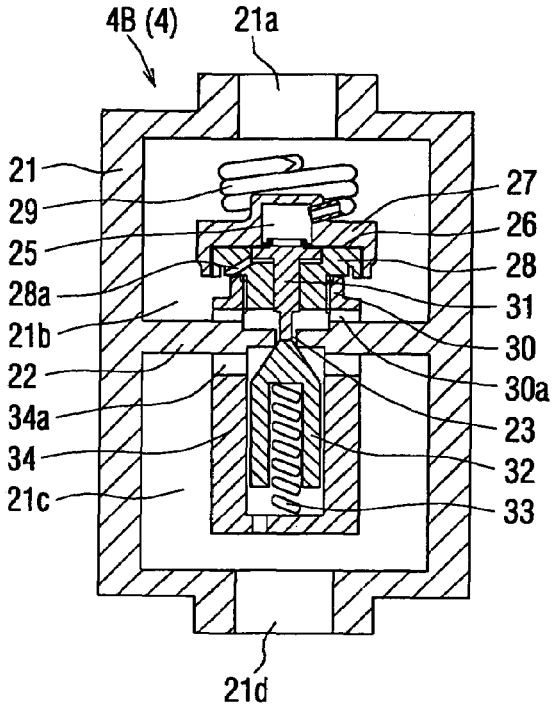
FIG. 5A is a sectional view showing a valve closing state of a mechanical expansion valve.

FIG. 5A is a sectional view showing a mechanical expansion valve 4B (pressure control valve 4) at a valve-closing state. In this embodiment, when the outside air temperature is lower than a low value, the valve port 23 is opened by an opening degree, so that refrigerant flows at a start time of the compressor 1 by an amount equal to or larger than a necessary smallest amount.

In the mechanical expansion valve 4B, the structures having functions similar to those of the mechanical expansion valve 4A are indicated by the same reference numbers. A transmission rod (push rod) 31 is connected to a valve body 32, and the valve body 32 is disposed in the downstream space 21*c* of the valve port 23 to open and close the valve port 23 from the downstream space 21*c* by a biasing force of the coil spring (elastic member) 33.

Furthermore, the transmission rod 31 contacts the valve body 32 at its tip ends. When the temperature around the sealed space 25 is lower than a predetermined value, the diaphragm 26 pushes the valve body 32 through the transmission rod 31 so that refrigerant flows in the valve port 23 by an amount. A cylindrical valve support portion 34 is provided around the valve port 23 in the downstream space 21*c*, and plural refrigerant flow holes 34*a* are provided in the valve support portion 34.

Figure 5B:
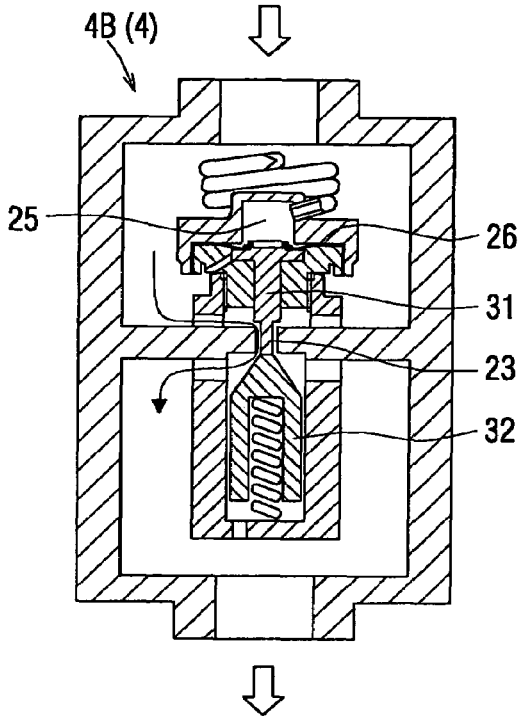
FIG. 5B is a sectional view of the mechanical expansion valve showing a state immediately after a stop or a start of a vapor-compression refrigerant cycle system.

FIG. 5B shows an operation state of the mechanical expansion valve 4B(4) when the pressure of the high-pressure refrigerant is low while the compressor 1 stops or at a time immediately after a start of the compressor 1. In this case, the sealed gas pressure of the sealed space 25 is higher than the pressure of the refrigerant in the upstream space 21*b* around the sealed space 25, and the diaphragm 26 is moved downwardly to push the valve body 32 through the push rod 31. Therefore, the valve port 23 is opened by an opening degree around a tip end portion of the valve body 32, and refrigerant flows in the valve port 23 at least by a predetermined amount.

Figure 5C:
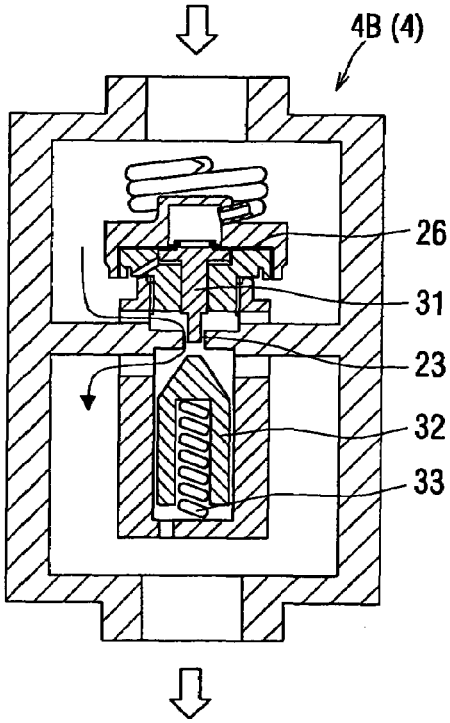
FIG. 5C is a sectional view of the mechanical expansion valve in a normal state, according to a second exemplary embodiment of the present invention.

FIG. 5C shows an operation state when the pressure of the high-pressure refrigerant reaches a set pressure. When the pressure of the high-pressure refrigerant increases to a value, the diaphragm 26 moves gradually upward from a state in FIGS. 5A, 5B. Thereafter, when the pressure of the high-pressure refrigerant increases to a valve-opening pressure, the coil spring 33 is compressed due to a pressure difference. In this case, the valve body 32 is separated from the transmission rod 31 to open the valve port 23, as shown in FIG. 5C. Therefore, a predetermined pressure difference can be maintained between high and low pressure sides of the mechanical expansion valve 4B (4) by the coil spring 33.

In this embodiment, the mechanical expansion valve 4B (4) is a pressure control valve that is disposed downstream from the interior heat exchanger 3 to control the refrigerant pressure at the outlet portion of the interior heat exchanger 3 in accordance with a refrigerant temperature at the outlet portion of the interior heat exchanger 3. The mechanical expansion valve 4B (4) includes the partition wall 22 for partitioning the inner space of the casing 21 into the upstream space 21*b* and the downstream space 21*c*. The valve port 23 is provided in the partition wall 22 so that the upstream space 21*b* and the downstream space 21*c* communicate with each other through the valve port 23.

The sealed space 25 is provided inside the upstream space 21*b*, and the diaphragm 26 displaces in accordance with a pressure difference between an inside and an outside of the sealed space 25 within the upstream space 21*b*. The transmission rod 31 is connected to the diaphragm 26 at one end of the diaphragm 26 in the moving direction of the diaphragm 26. The valve body 32 is disposed in the downstream space 21*c* of the valve port 23 and is biased by the biasing force of the coil spring 33 in the valve-closing direction. The coil spring 33 is located in the downstream space 21*c*.

Furthermore, the sealed space 25 is filled with gas that has a pressure change with respect to temperature, and the pressure change of the sealed gas with respect to the temperature is smaller than that of the refrigerant circulating in the refrigerant cycle system. The transmission rod 31 and the valve body 32 are provided to contact at its tip ends. When the surround temperature (i.e., the refrigerant temperature introduced to the upstream space 21*b*) of the sealed space 25 is lower than a predetermined temperature, the diaphragm 26 pushes the valve body 32 through the transmission rod 31 so that refrigerant flows through the valve port 23 by a predetermined amount, as shown in FIG. 5B.

Accordingly, at a low outside air temperature, high-temperature refrigerant can flow into the interior heat exchanger 3, and it can prevent the heating due to the interior heat exchanger 3 from deteriorating. That is, the refrigerant cycle system can be operated to increase the heating capacity of the interior heat exchanger 3 during the heating operation, regardless of the COP.

Third Exemplary Embodiment

Figure 6:
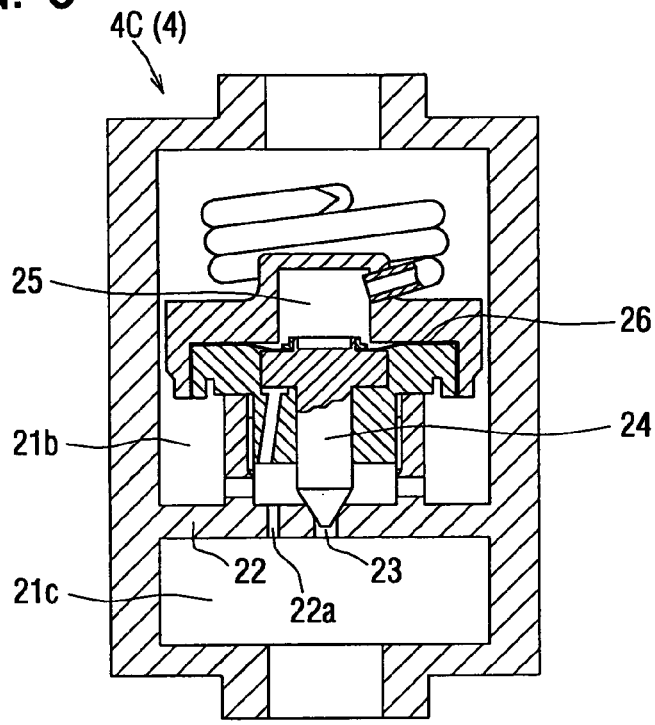
FIG. 6 is a sectional view of a mechanical expansion valve in a valve closing state according to a third exemplary embodiment of the present invention.

FIG. 6 shows a valve-closing state of a mechanical expansion valve 4C (4) used in a heating operation according the third exemplary embodiment.

In the above-described first exemplary embodiment, when the valve port 23 is closed by the valve body 24, refrigerant does not passes through the mechanical expansion valve 4A and refrigerant does not circulate to the interior heat exchanger 3. However, in this embodiment, a bypass hole 22*a* is provided in the partition wall 22 in a mechanical expansion valve 4C (4), as shown in FIG. 6. In the mechanical expansion valve 4C, the other structure may be formed similarly to that of the mechanical expansion valve 4A.

In the mechanical expansion valve 4C (4) of this embodiment, a predetermined refrigerant flows through the bypass hole 22*a* even when the valve port 23 is closed by the valve body 24. Gas is sealed in the sealed space 25 by a density that is in a range between a saturated liquid density at a refrigerant temperature of 0° C. and a saturated liquid density at a critical point, with respect to the inner volume of the sealed space 25 when the valve port 23 is closed.

The mechanical expansion valve 4C (4) may be arranged downstream from the interior heat exchanger 3, similarly to the mechanical expansion valve 4A of the above-described first exemplary embodiment. Furthermore, in this embodiment, even when the valve port 23 is closed by the valve body 24 when the operation of the compressor 1 starts, refrigerant flows through the mechanical expansion valve 4C (4). Therefore, the operation of the compressor 1 normally starts at least by a refrigerant amount necessary for the normal start. Accordingly, a necessary heating capacity can be rapidly obtained using the interior heat exchanger 3.

Fourth Exemplary Embodiment

Figure 7A:
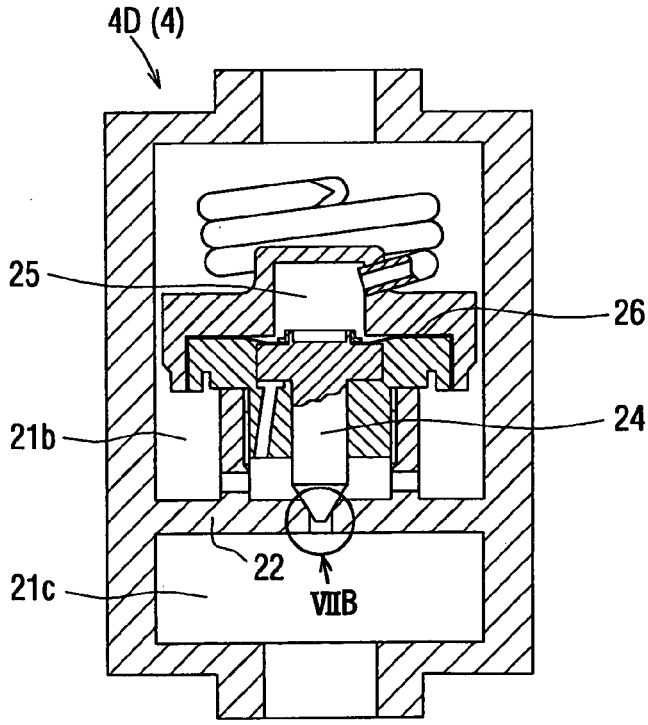
FIG. 7A is a sectional view of a mechanical expansion valve in a valve closing state according to a fourth exemplary embodiment of the present invention.
Figure 7B:
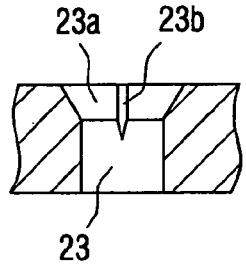
FIG. 7B is an enlarged view of the part VIIB in FIG. 7A.
Figure 8A:
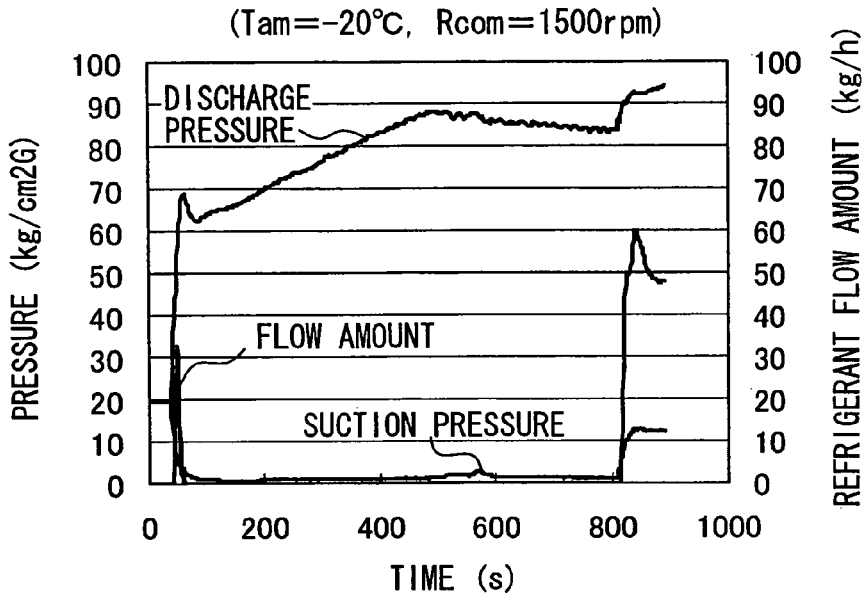
FIG. 8A RELATED ART
Figure 8B:
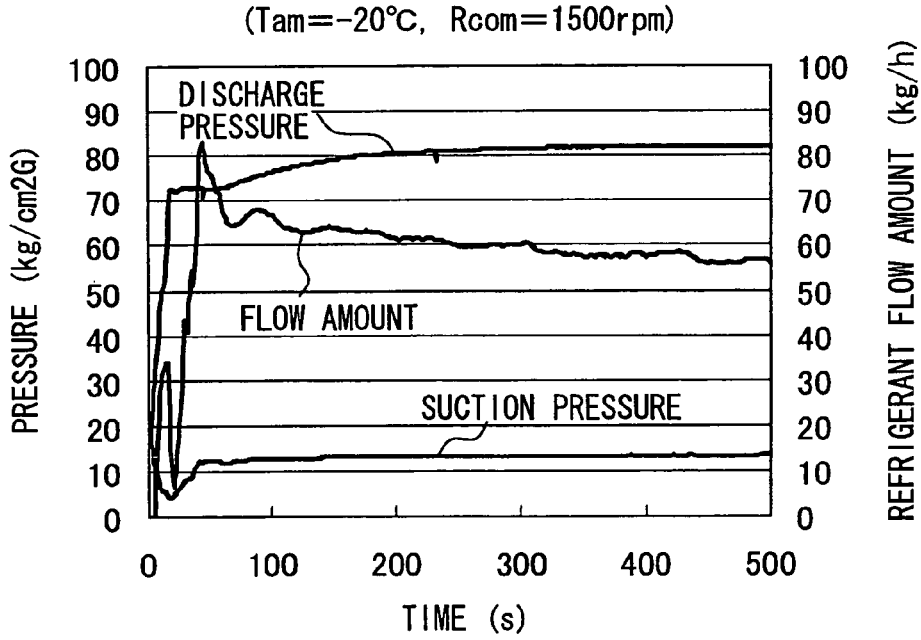
FIG. 8B RELATED ART

FIG. 7A shows a valve closing state of a mechanical expansion valve 4D (4) used for a heating operation according to the fourth exemplary embodiment. FIG. 7B is an enlarged view of the part shown by VIIB in FIG. 7A. In FIGS. 7A, 7B, a groove portion 23*b* is provided in a seat portion 23*a* of the valve port 23, contacting the valve body 24. Therefore, even when the valve body 24 contacts the seat portion 23*a* of the valve port 23, refrigerant flows through the groove portion 23*b*. Accordingly, heating capacity due to the interior heat exchanger 3 can be rapidly obtained.

Other Embodiments

Although the present invention has been described in connection with some exemplary embodiments thereof with reference to the accompanying drawings, it is to be noted that various changes and modifications will become apparent to those skilled in the art.

For example, in the above-described embodiments, the supercritical heat pump cycle system (refrigerant cycle system) is typically used for a vehicle air conditioner. However, the supercritical heat pump cycle system may be used for a water heater for heating water. In this case, water to be supplied can be heated using the high-temperature refrigerant in the interior heat exchanger 3.

While the invention has been described with reference to exemplary embodiments thereof, it is to be understood that the invention is not limited to the exemplary embodiments and constructions. The invention is intended to cover various modification and equivalent arrangements. In addition, while the various elements of the exemplary embodiments are shown in various combinations and configurations, which are exemplary, other combinations and configuration, including more, less or only a single element, are also within the spirit and scope of the invention.

What is claimed is:

1. A pressure control valve for a vapor-compression refrigerant cycle system that includes a refrigerant radiator in which refrigerant having a pressure higher than a critical pressure, compressed by a refrigerant compressor, flows, the pressure control valve comprising:

a valve portion disposed in a refrigerant passage from the refrigerant radiator to a suction port of the refrigerant compressor, wherein:

the valve portion controls a refrigerant pressure at an outlet of the refrigerant radiator in accordance with a refrigerant temperature at the outlet of the refrigerant radiator;

the valve portion has a control pressure characteristic in which a pressure change relative to a temperature change is smaller than that of the refrigerant;

the refrigerant radiator is configured in the vapor-compression refrigerant cycle system to radiate heat to an object to be heated; and the valve portion controls the refrigerant pressure at the outlet of the refrigerant radiator to be higher than a pressure value at which the coefficient of performance of the vapor-compression refrigerant cycle system becomes maximum, when a temperature of the outside air is lower than a predetermined temperature.

2. The pressure control valve according to claim 1, wherein the valve portion includes a casing for defining a refrigerant passage, a partition portion arranged in the refrigerant passage to partition an inner space of the casing into an upstream space and a downstream space, a valve port provided in the partition portion, through which the upstream space communicates with the downstream space, a sealed space provided inside the upstream space, a film-shaped displacement member provided in the upstream space, wherein the displacement member moves in accordance with a pressure difference between an inside and an outside of the sealed space within the upstream space, and a valve body which is connected to the displacement member and is moved in accordance with a movement of the displacement member to open and close the valve port; and wherein the sealed space is filled with a gas that has a pressure change with respect to temperature, smaller than that of the refrigerant.

3. The pressure control valve according to claim 2, wherein the partition wall has a bypass hole through which the upstream space communicates with the downstream space and the refrigerant flows while bypassing the valve port.

4. The pressure control valve according to claim 2, wherein:

the valve port has a seat portion which is arranged to contact the valve body; and the seat portion has a groove portion through which the upstream space communicates with the downstream space even when the valve body contacts the seat portion.

5. The pressure control valve according to claim 1, wherein the valve portion includes a casing for defining a refrigerant passage, a partition portion arranged in the refrigerant passage to partition an inner space of the casing into an upstream space and a downstream space, a valve port provided in the partition portion, through which the upstream space communicates with the downstream space, a sealed space provided inside the upstream space, a film-shaped displacement member provided in the upstream space, wherein the displacement member moves in accordance with a pressure difference between an inside and an outside of the sealed space within the upstream space, a transmission rod which is connected to the displacement member and is moved in accordance with a movement of the displacement member, an elastic member disposed in the downstream space, and a valve body disposed to open and close the valve port from the downstream space by a biasing force of the elastic member; and wherein the sealed space is filled with a gas that has a pressure change with respect to temperature, smaller than that of the refrigerant.

6. The pressure control valve according to claim 5, wherein:

the transmission rod has a tip end that is arranged to contact a tip end of the valve body; and when a temperature outside the sealed space within the upstream space is lower than a first value, the displacement member pushes the valve body through the transmission rod so that the valve port is opened by an opening degree.

7. The pressure control valve according to claim 5, wherein:

the transmission rod includes a tip rod portion having the tip end, and the tip rod portion is movable in the valve port.

8. The pressure control valve according to claim 5, wherein the tip end of the transmission rod is separated from the tip end of the valve body when the temperature outside the sealed space within the upstream space is higher than a second value that is higher than the first value.

9. The pressure control valve according to claim 1, wherein the valve portion has a valve-open pressure that is 10±1.5 MPa at 40° C., and is 8±1.5 MPa at 0° C.

10. The pressure control valve according to claim 1, wherein the valve portion defines a sealed chamber, the sealed chamber being filled with a gas different than the refrigerant.

11. A vapor-compression refrigerant cycle system comprising:

a compressor for compressing refrigerant to have a pressure higher than a critical pressure of the refrigerant;

a refrigerant radiator for radiating the refrigerant discharged from the compressor, the refrigerant radiator has therein a refrigerant pressure higher than the critical pressure; and a pressure control valve for controlling a refrigerant pressure at an outlet of the refrigerant radiator in accordance with a refrigerant temperature at the outlet of the refrigerant radiator, wherein:

the pressure control valve includes a valve portion that has a control pressure characteristic in which a pressure change relative to a temperature change is smaller than that of the refrigerant;

the refrigerant radiator is configured in the vapor-compression refrigerant cycle system to radiate heat to an object to be heated; and the pressure control valve controls the refrigerant pressure at the outlet of the refrigerant radiator to be higher than a pressure value at which the coefficient of performance of the vapor-compression refrigerant cycle system becomes maximum, when a temperature of the outside air is lower than a predetermined temperature.

12. The vapor-compression refrigerant cycle system according to claim 11, wherein the valve portion includes a casing for defining a refrigerant passage, a partition portion arranged in the refrigerant passage to partition an inner space of the casing into an upstream space and a downstream space, a valve port provided in the partition portion, through which the upstream space communicates with the downstream space, a sealed space provided inside the upstream space, a film-shaped displacement member provided in the upstream space, wherein the displacement member moves in accordance with a pressure difference between an inside and an outside of the sealed space within the upstream space, and a valve body which is connected to the displacement member and is moved in accordance with a movement of the displacement member to open and close the valve port; and wherein the sealed space is filled with a gas that has a pressure change with respect to temperature, smaller than that of the refrigerant.

13. The vapor-compression refrigerant cycle system according to claim 11, wherein the valve portion includes a casing for defining a refrigerant passage, a partition portion arranged in the refrigerant passage to partition an inner space of the casing into an upstream space and a downstream space, a valve port provided in the partition portion, through which the upstream space communicates with the downstream space, a sealed space provided inside the upstream space, a film-shaped displacement member provided in the upstream space, wherein the displacement member moves in accordance with a pressure difference between an inside and an outside of the sealed space within the upstream space, a transmission rod which is connected to the displacement member and is moved in accordance with a movement of the displacement member, an elastic member disposed in the downstream space, and a valve body disposed to open and close the valve port from the downstream space by a biasing force of the elastic member; and wherein the sealed space is filled with a gas that has a pressure change with respect to temperature, smaller than that of the refrigerant.

14. The vapor-compression refrigerant cycle system according to claim 11, wherein the valve portion includes the passage means through which the refrigerant flows even when the valve body closes the valve port at a start time of the compressor.

15. The vapor-compression refrigerant cycle system according to claim 14, wherein the passage means is a bypass hole provided in the partition wall, through which the upstream space communicates with the downstream space and the refrigerant flows while bypassing the valve port.

16. The vapor-compression refrigerant cycle system according to claim 14, wherein:

the valve port has a seat portion which is provided to contact the valve body; and the passage means is a groove portion through which the upstream space communicates with the downstream space even when the valve body contacts the seat portion.

17. The vapor-compression refrigerant cycle system according to claim 11, wherein the valve portion has a valve-open pressure that is 10±1.5 MPa at 40° C., and is 8±1.5 MPa at 0° C.

18. The vapor-compression refrigerant cycle system according to claim 11, wherein the pressure control valve controls the refrigerant pressure at the outlet of the refrigerant radiator to have a refrigerant flow amount larger than a predetermined amount at a heating start time of the fluid.

19. The vapor-compression refrigerant system according to claim 11, wherein the pressure control valve defines a sealed chamber, the sealed chamber being filled with a gas different than the refrigerant.

* * * * *

UNITED STATES PATENT AND TRADEMARK OFFICE

CERTIFICATE OF CORRECTION

PATENT NO. : 7,607,315 B2
APPLICATION NO. : 11/147029
DATED : October 27, 2009
INVENTOR(S) : Hiromi Ohta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1167 days.

Signed and Sealed this

Twelfth Day of October, 2010

David J. Kappos

David J. Kappos
*Director of the United States Patent and Trademark Office*